US006328521B1

(12) United States Patent
Givati

(10) Patent No.: US 6,328,521 B1
(45) Date of Patent: Dec. 11, 2001

(54) VEHICLE PARKING SYSTEM

(75) Inventor: Itzhak Givati, Tel Aviv (IL)

(73) Assignee: Shakbar Investments, Ltd., Tel Aviv (IL)

( * ) Notice: Subject to any disclaimer, the term of this patent is extended or adjusted under 35 U.S.C. 154(b) by 0 days.

(21) Appl. No.: 09/142,354

(22) PCT Filed: Mar. 10, 1997

(86) PCT No.: PCT/IL97/00090

§ 371 Date: Mar. 27, 2000

§ 102(e) Date: Mar. 27, 2000

(87) PCT Pub. No.: WO98/40586

PCT Pub. Date: Sep. 17, 1998

(51) Int. Cl.[7] ..... E04H 6/12

(52) U.S. Cl. ..... 414/234; 414/239; 414/241; 414/262

(58) Field of Search ..... 414/234, 239, 414/241, 253, 261, 262

(56) References Cited

U.S. PATENT DOCUMENTS

| | | | | |
|---|---|---|---|---|
| 2,904,200 | | 9/1959 | Diehl . | |
| 2,936,082 | * | 5/1960 | Alimenestiano | 414/234 |
| 3,042,228 | * | 7/1962 | Frangos | 414/234 |
| 3,294,260 | * | 12/1966 | Frangos | 414/261 |
| 4,874,280 | * | 10/1989 | Gamberini | 414/234 |
| 4,971,506 | * | 11/1990 | Givati | 414/253 |
| 4,986,714 | * | 1/1991 | Fernstrom | 414/262 |
| 5,013,203 | * | 5/1991 | Wakabayashi | 414/234 |

FOREIGN PATENT DOCUMENTS

| | | | | |
|---|---|---|---|---|
| 44 42 169 | | 5/1996 | (DE) . | |
| 0 238 673 | | 4/1987 | (EP) . | |
| 0 340 673 | | 11/1989 | (EP) . | |
| 0 517 920 | | 12/1992 | (EP) . | |
| 1099082 | | 3/1955 | (FR) . | |
| 218165 | * | 4/1987 | (FR) | 414/239 |
| 3036372 | * | 2/1991 | (JP) | 414/253 |
| 3267479 | * | 11/1991 | (JP) | 414/234 |
| 5039677 | * | 2/1993 | (JP) | 414/234 |
| 5133130 | * | 5/1993 | (JP) | 414/234 |
| WO 89/09866 | | 10/1989 | (WO) . | |

* cited by examiner

*Primary Examiner*—James W. Keenan

(57) ABSTRACT

A vehicle parking system including a pair of horizontal rails (11,12) spaced apart to define a line of vehicle parking spaces between them, a horizontal carrier (10) movable over the rails (11,12) for conveying vehicles to selected parking spaces, and a vertical lift laterally of the pair of rails (11,12) for lifting onto the horizontal carrier (10) a vehicle to be parked, the horizontal carrier (10) comprising a frame structure for receiving a vehicle to be parked, and four legs (14) depending from four corners of the frame structure and carrying wheels (15) rollable along the rails (11,12), the legs (14) being of a height to enable the frame structure, and the vehicle supported thereby, to move over other vehicles that may be parked in the parking spaces, at least the rail (11) adjacent to the vertical lift being interrupted to produce a gap **(11*a*) sufficiently large to accommodate the vertical lift when lifting a vehicle onto the horizontal carrier (10)**.

21 Claims, 8 Drawing Sheets

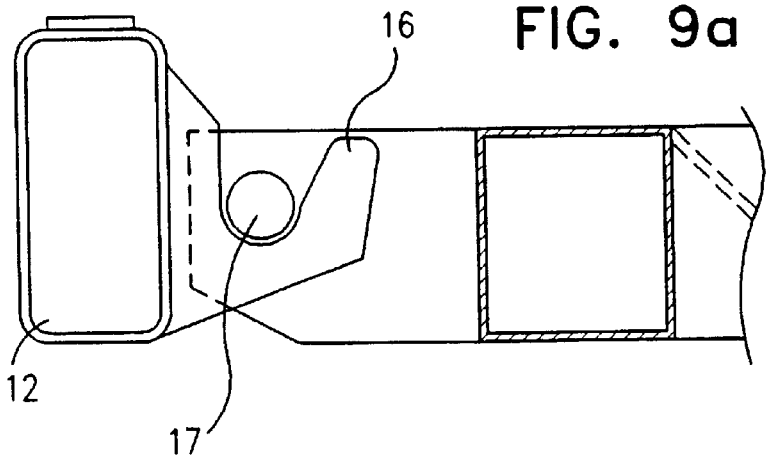
FIG. 9a
FIG. 9b
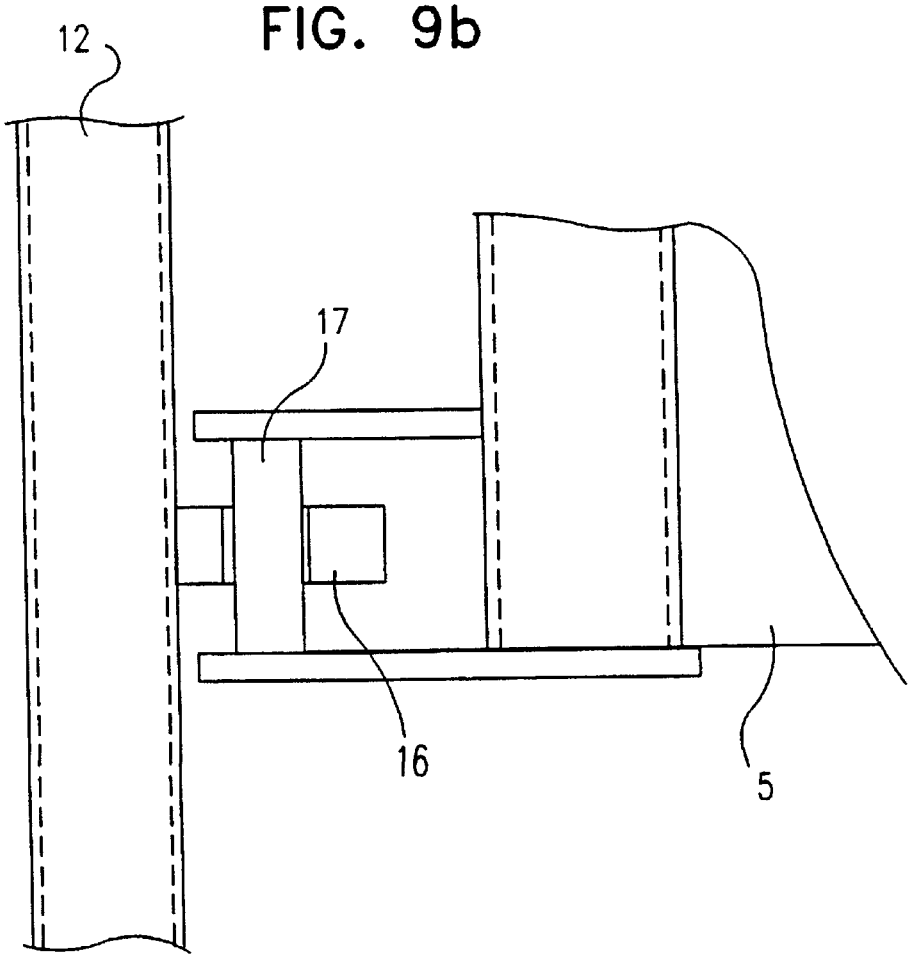

VEHICLE PARKING SYSTEM

The present invention relates to vehicle parking systems. The invention is particularly useful with respect to the vehicle parking system described in my prior Israel Patent 86295, and is therefore described below with respect to that application.

The problem of providing parking spaces for automotive vehicles is becoming increasingly serious because of the increase in demand for parking spaces, and the decrease in supply of land available for such parking spaces, particularly in commercial centers or densely populated areas. My above-cited patent describes a multi-level parking system which enables almost any available plot of land to be used for providing a large number of parking spaces since the described system accommodates itself to the shape, dimensions, and topography of the available plot of land.

An object of the present invention is to provide a vehicle parking system which provides a number of important advantages particularly when used in the system described in that patent, but which may also advantageously be used in other systems.

According to one aspect of the present invention, there is provided a vehicle parking system comprising a vehicle parking system, comprising a pair of horizontal rails spaced apart to define a line of vehicle parking spaces between them; a horizontal carrier movable over the rails for conveying vehicles to selected parking spaces; and a vertical lift laterally of the pair of rails for lifting onto the horizontal carrier a vehicle to be parked; the horizontal carrier comprising: a frame structure for receiving a vehicle to be parked, and four legs depending from four corners of the frame structure and carrying wheels rollable along the rails; the legs being of a height to enable the frame structure, and the vehicle supported thereby, to move over other vehicles that may be parked in the parking spaces; at least the rail adjacent to the vertical lift being interrupted to produce a gap sufficiently large to accommodate the vertical lift when lifting a vehicle onto the horizontal carrier.

As will be described more fully below, such a parking system, when used in the system of the above-cited patent, substantially reduces the time for parking and retrieving vehicles, primarily for two reasons: First, it enables transferring the vehicle between the vertical lift and the horizontal carrier at the lifted position of the vehicle on the horizontal carrier, thereby saving the time of the horizontal carrier to lift the vehicle in order to pass over vehicles that may be parked in the line of parking spaces to be traversed by the horizontal carrier when parking and retrieving a vehicle. In addition, this arrangement enables the vertical lift to be located at an intermediate position in the line of parking devices at the respective level, rather than at one end of the line of parking spaces, thereby shortening the transmit time of a vehicle when parking or retrieving it.

According to another aspect of the present invention, there is provided a vehicle parking system comprising: a supporting structure having a plurality of parking levels; each of the levels including a pair of horizontal rails spaced apart to define a line of vehicle parking spaces between them, a plurality of trays supported on the rails, and a horizontal carrier movable over the rails of the respective level for conveying vehicles to the trays of selected parking spaces; and a vertical lift for lifting a vehicle to be parked to the horizontal carrier of a selected level; the pair of horizontal rails of each level being curved, and the horizontal carrier of each level having pivotally mounted wheels to enable the horizontal carrier to traverse the curved rails.

This feature better enables the parking system to accommodate itself according to the size and shape of the available plot of land to be used for parking purposes.

Further features and advantages of the invention will be apparent from the description below.

The invention is herein described, by way of example only, with reference to the accompanying drawings, wherein.

Figure 7A:
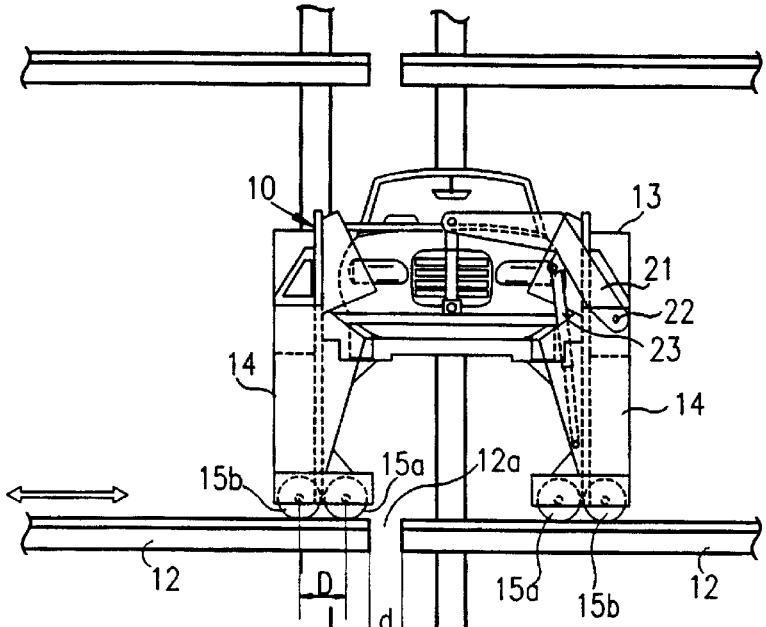
Figure 7B:
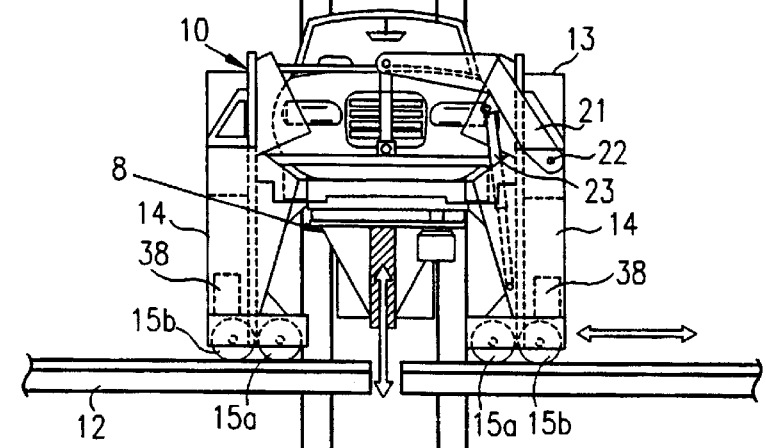
Figure 7C:
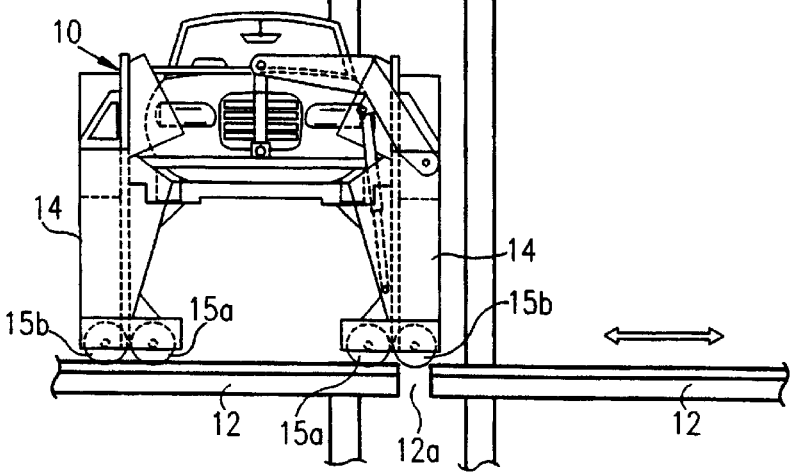
Figure 9:
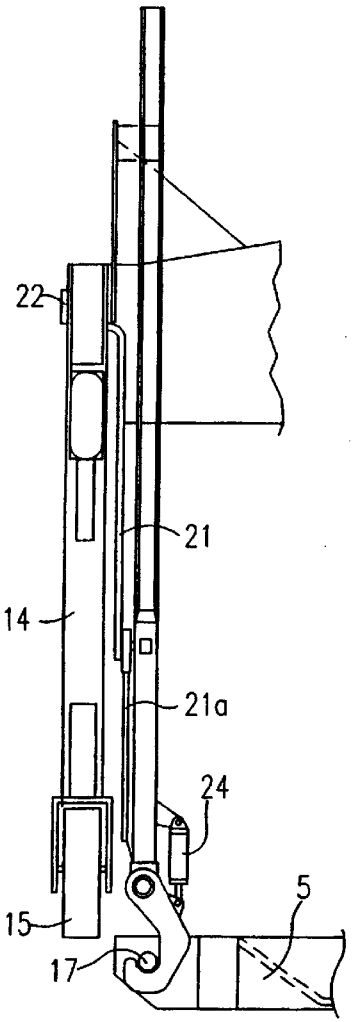
Figure 8:
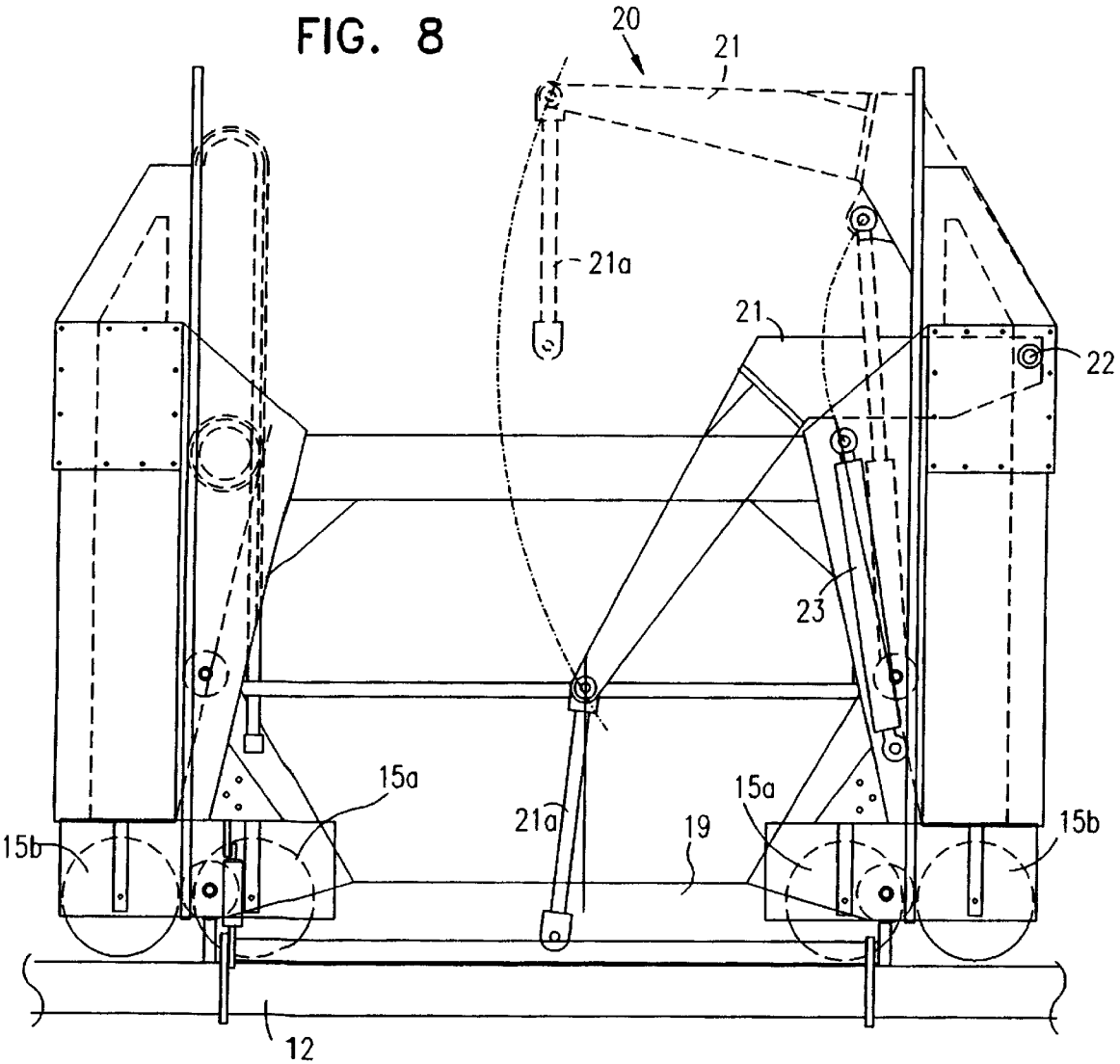
Figure 10:
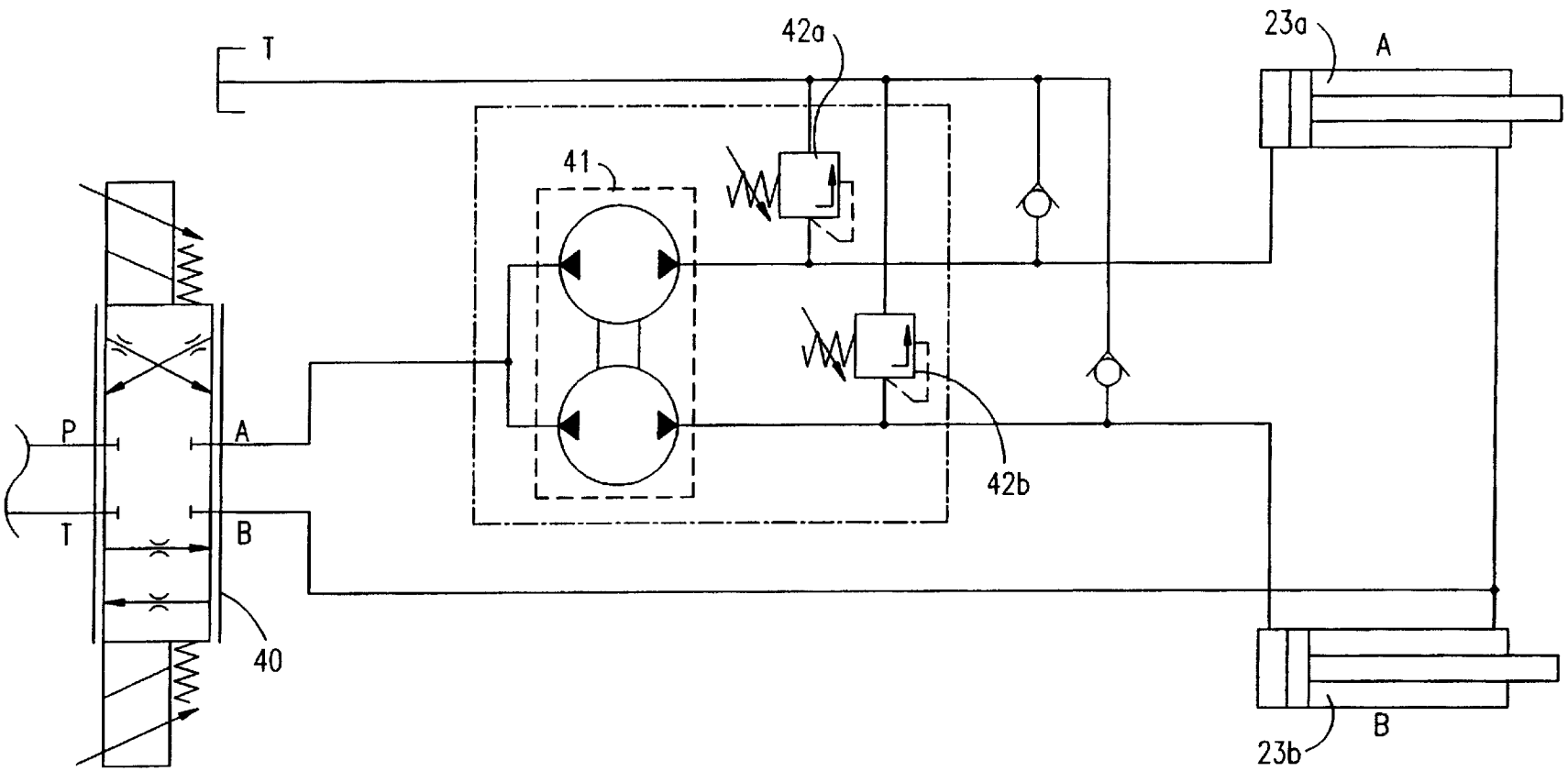
Figure 11:
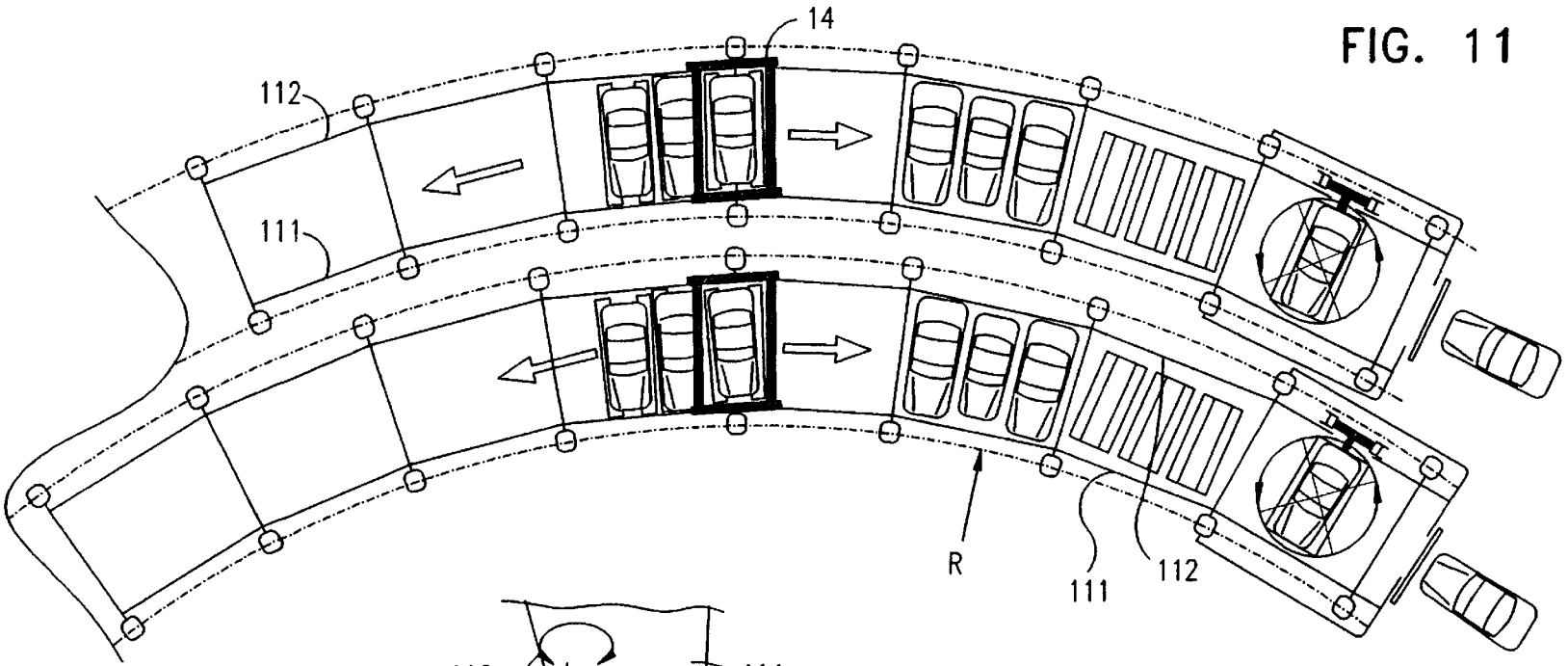
Figure 12:
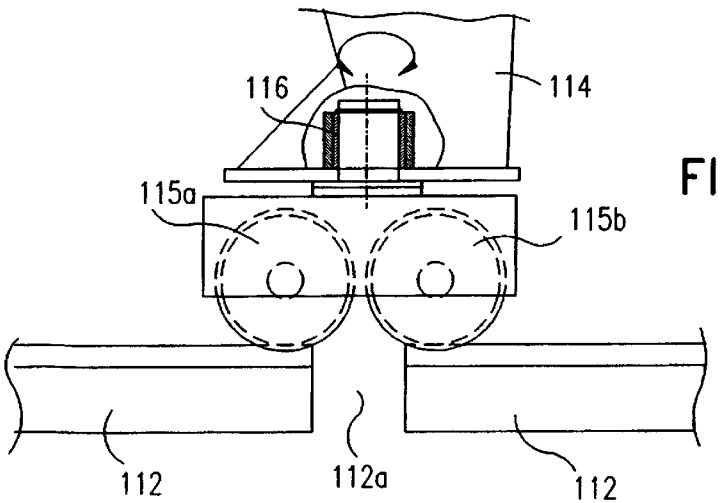

FIGS. 7*a*–7*c* illustrate three phases in the movement of the horizontal carrier, and the vehicle conveyed thereby, with respect to the rails and the vertical lift;

FIG. 8 is a schematic diagram illustrating the raising and lowering mechanism included in each horizontal carrier;

FIG. 9 is a side elevational view illustrating the raising and lowering mechanism and also the securing devices for securing a vehicle tray to the horizontal carrier;

FIGS. 9*a* and 9*b* are end and plan views, respectively, more particularly illustrating the manner of supporting the trays on the rails and of securing the trays to the horizontal carrier;

FIG. 10 is a diagram illustrating the hydraulic circuit included in the raising and lowering mechanism for each horizontal carrier;

FIG. 11 is a top plan view illustrating a variation in the construction of the vehicle parking system to better enable it to accommodate itself according to the shape of the available plot of land; and FIG. 12 illustrates a modification in the construction of the horizontal carrier when used in the system of FIG. 11.

The parking system illustrated in FIGS. 1–3 as one example of the invention includes a supporting structure, generally designated 2, constructed to provide a plurality of vertical columns C1–C3, with each vertical column having a plurality of parking levels, e.g., a street level SL, three levels L1–L3 below the street level, and two levels L4, L5 above the street level. Supporting structure 2 may be a permanent building structure, or part thereof, specially constructed for parking purposes, or it may be a temporary open frame structure for providing temporary vehicle parking spaces. The supporting structure may be of a modular construction, e.g. as described in the above-cited patent, or may be of a non-modular construction specially designed for the particular building site.

Figure 1:
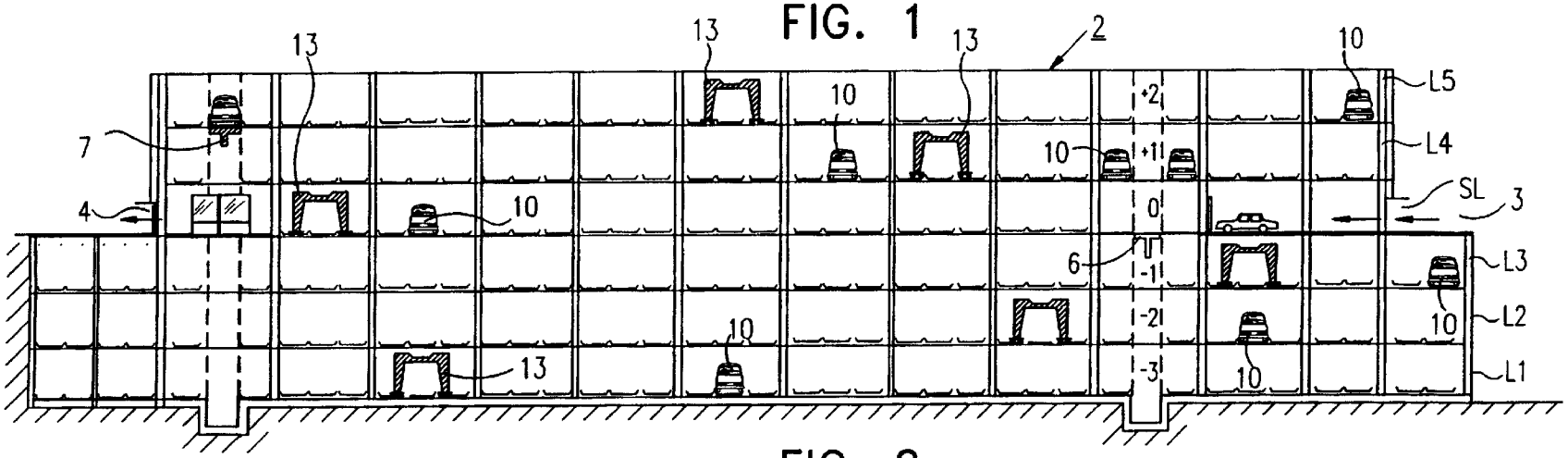
FIG. 1 is a side elevational view illustrating one form of vehicle parking system constructed in accordance with the present invention.

As shown particularly in FIG. 1, each vertical column has two street-level entrance/exit points 3, 4 at the opposite ends of the structure. Each point may serve as an entrance or as an exit. For example, during morning rush hours, both may serve only as entrances to speed up the parking of vehicles, and during afternoon rush hours, both may serve as exits to speed up retrieving the vehicles; at all other times, one point may serve as an entrance and the other as an exit, or each may serve both as an entrance and as an exit.

As will be described more particularly below, each parking space in the parking system is provided with a tray 5 (e.g., FIG. 4) which receives the vehicle when entering the parking system, and which stays with the vehicle until the vehicle exits from the parking system.

Figure 2:
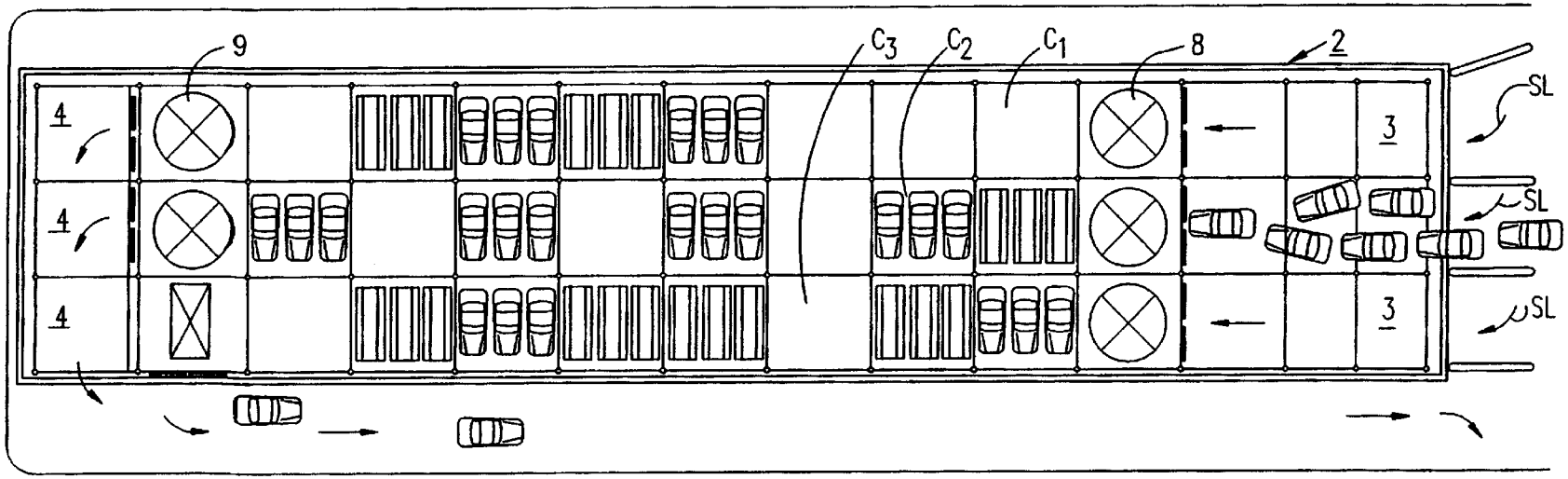
FIG. 2 is a top plan view of the parking system of FIG. 1.
Figure 3:
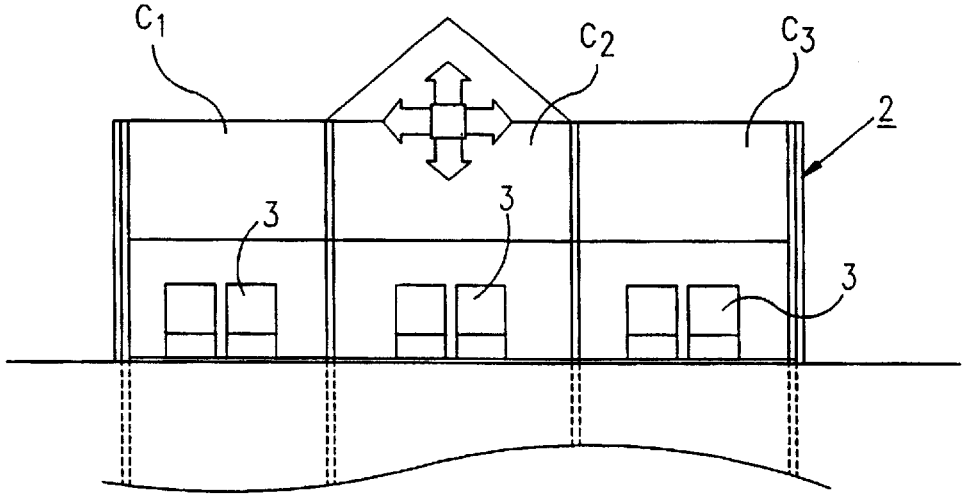
FIG. 3 is a front elevational view of the parking system of FIGS. 1 and 2.

In the example illustrated in FIGS. 1 and 2, each vertical column of the parking system is serviced by two vertical lifts 6, 7 at the opposite ends of structure 2 adjacent to the entrance/exit points 3, 4. Each vertical lift is provided with a turntable 8, 9 (FIG. 2) which receives the tray 5 for a vehicle to be handled, and rotates the tray and the vehicle 90 degrees such that the vehicles may be parked in a tight side-by-side relation within the structure 2, rather than in an end-to-end relation.

Each level in each vertical column C1–C3 of parking spaces is provided with a horizontal carrier, generally designated 10, which receives the tray 5 and the vehicle thereon from the vertical lift of the respective column and conveys both to a selected parking space in the respective level. As will be described below, each horizontal conveyor 10 conveys the tray and the vehicle thereon over other vehicles that may already be parked in the respective line of parking spaces, until it arrives at the parking space selected for the respective vehicle, and then lowers the tray with the vehicle thereon into the parking space.

Each level includes a pair of horizontal rails 11, 12 spaced apart to define a line of vehicle parking spaces between them. Each parking space is occupied by one of the trays 5 which is supported on the rails. The pair of rails 11, 12 of one level are vertically spaced from those of the next adjacent level by a distance which is more than twice the height of the vehicles to be parked.

Each horizontal carrier 10 comprises a frame structure 13 for receiving a tray 5 carrying a vehicle to be parked, and four legs 14 depending from the four corners of the frame structure 13 and carrying wheels 15 rollable along the rails 11, 12. The legs 14 are of a height to enable the frame structure 13, and the vehicle supported thereby, to move over other vehicles that may be parked in the parking spaces, when conveying a vehicle to or from a selected parking space.

As indicated earlier, each parking space on each level is occupied by a tray 5 for receiving the vehicle to be parked in that space. As shown in FIGS. 9*a* and 9*b*, the two rails 11, 12 (only rail 12 being therein shown) are provided with a pair of hooks 16 receiving laterally projecting pins 17 carried at the opposite ends of each tray 5. Pins 17 of the trays are thus used for supporting the trays between the two rails 11, 12. These pins are also used for securing the tray, and the vehicle carried thereby, to the horizontal carrier 10 when being conveyed to or from its respective parking space. Thus, when a tray is secured to the horizontal carrier 10, pins 17 of the tray are engageable by securing devices, in the form of hooks, carried by a vehicle supporting carriage 19 mounted on the horizontal carrier 10. Horizontal carrier 10 further includes a raising and lowering mechanism 20 for raising and lowering the carriage 19 with respect to the frame structure 13 of the horizontal carrier 10.

Figure 5:
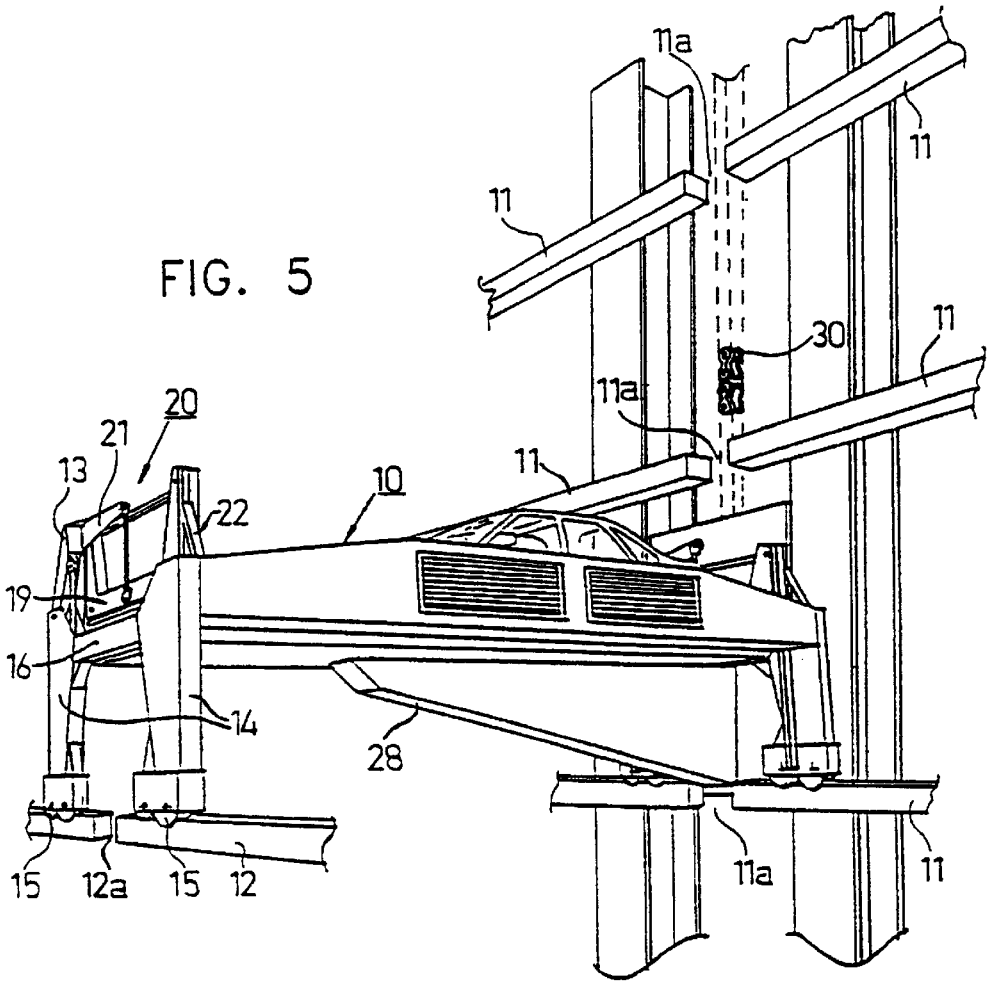
FIG. 5 is a perspective view illustrating the horizontal carrier and the vertical lift.

As shown particularly in FIGS. 5, 8 and 9, the raising and lowering mechanism 20 includes a pair of arms 21 pivotally mounted at one end 22 to each end of the carrier frame structure 13. The opposite end of each arm 21 is pivotally connected to one end of a link 21*a*, the opposite end of the link being pivotally coupled to the vehicle supporting carriage 19. Arm 21 is pivoted about its pivot 22 by a hydraulic cylinder 23, which is contracted to move the arm to its lower position as shown in full lines in FIG. 8, and is extended to move the arm to its raised position as shown in broken lines in FIG. 8.

Carriage 19 further includes another hydraulic cylinder 24 for each of the securing hooks, as shown in FIG. 9. Thus, in the extended position of ram cylinder 24, it actuates its hook to engage the respective pin 17 carried by the vehicle tray 5 as shown in FIG. 9; and in the retracted position of the hydraulic cylinder, it pivots the hook so its release position with respect to the tray pin 17.

The rails 11, 12 for each level are interrupted at the location occupied by the vertical lift 6 (or 7). This is more particularly shown in FIGS. 5 and 7*a*–7*c*, wherein it will be seen that rail 11 is interrupted to define a gap 11*a*, and similarly rail 12 is interrupted to define a gap 12*a*. These gaps 11*a*, 12*a* are dimensioned to accommodate the vertical lift 6 (or 7) serving all the levels of the respective column, and therefore they are in vertical alignment with each other in all the levels.

Figure 4:
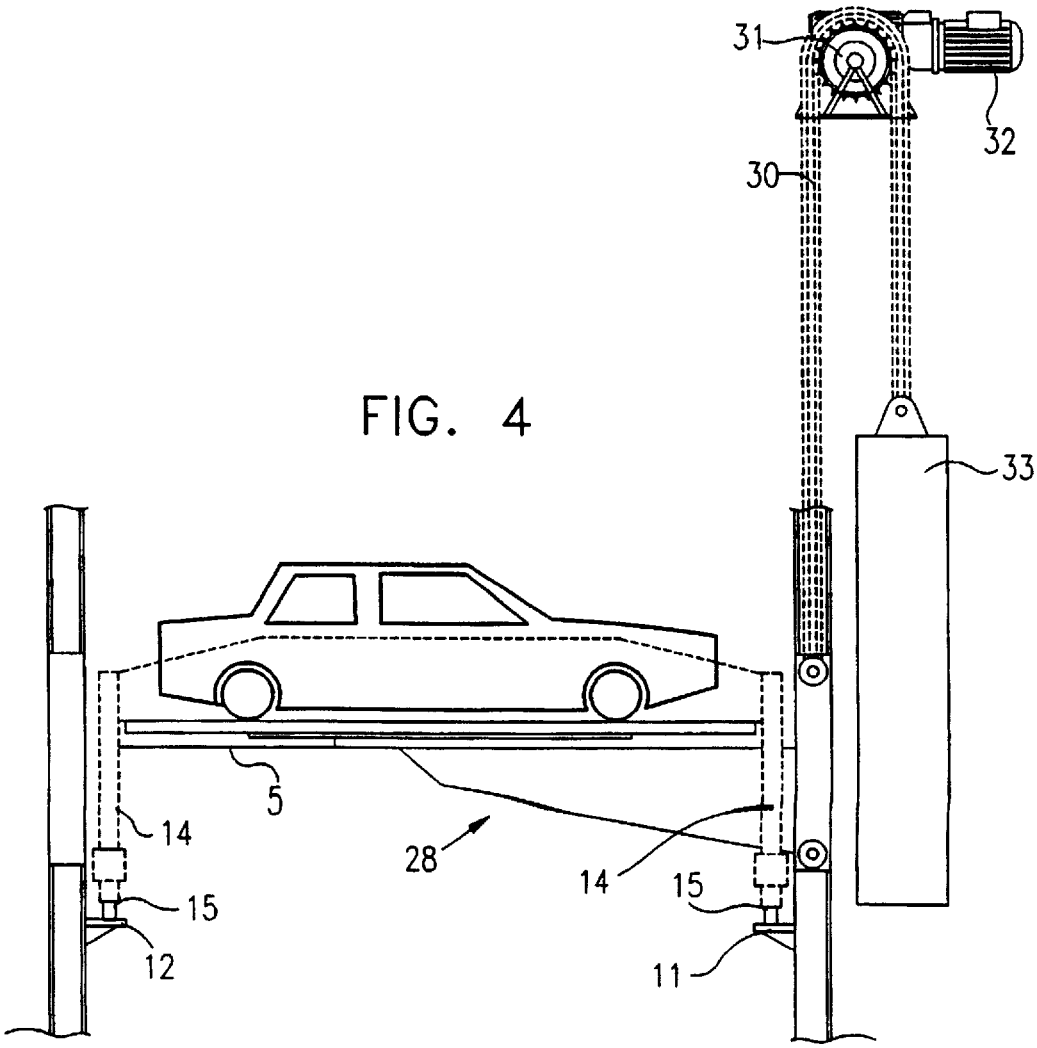
FIG. 4 is a side elevational view illustrating particularly the vertical lift in the parking system of FIGS. 1 and 2.

In the example illustrated in FIGS. 4 and 5, the vertical lift 6 includes a cantilever arm 28 mounted laterally of rail 11 and movable vertically via the gaps 11*a* in rail 11. Cantilever arm 28 is carried by a sprocket chain 30 received over a sprocket wheel 31 rotated by a motor 32 and carrying a counterweight 33 at its opposite end.

Since the construction illustrated in FIGS. 4 and 5 utilizes a cantilever arm 28 in the vertical lift, a gap (11*a*) in only one of the rails (11) is needed to accommodate the arm; therefore, a gap (12*a*) in the second rail (12) may be omitted, or it may be retained for purposes of symmetry.

Figure 6:
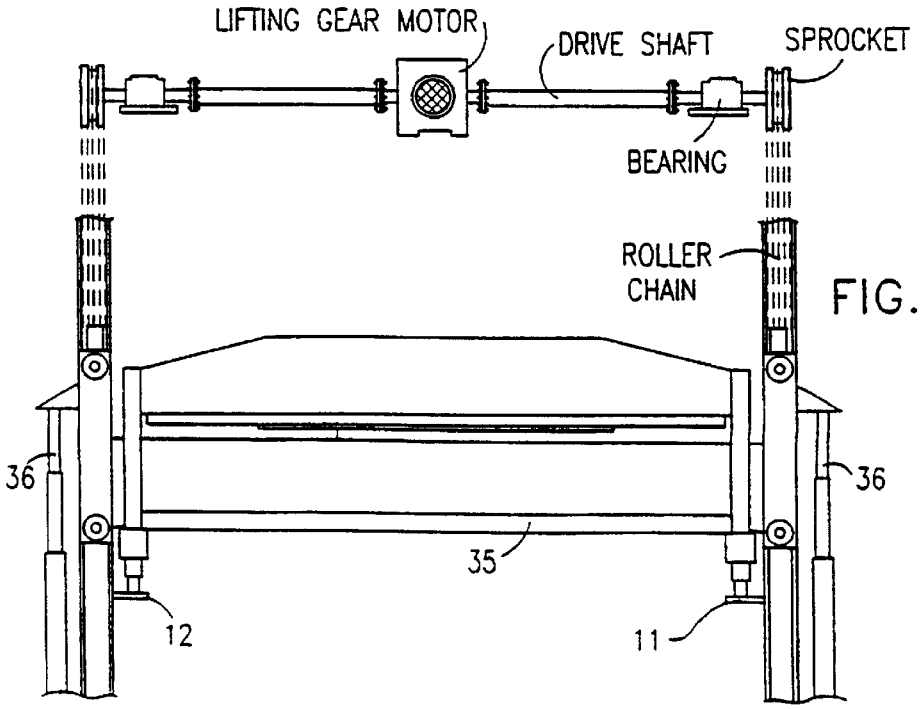
FIG. 6 is a side elevational view illustrating a variation in the construction of the vertical lift.

FIG. 6 illustrates a variation wherein the vertical lift includes an arm 35 extending transversely across both of the rails 11, 12, and therefore gaps 11*a*, 12*a* would be provided in both rails. FIG. 6 also illustrates the variation wherein a hydraulic cylinder 36 is provided for lifting and lowering arm 35. such a hydraulic drive may be provided only on one side of the pair of rails as in FIGS. 4, 5, or on both sides as illustrated in FIG. 6.

As shown particularly in FIGS. 5 and 7*a*–7*c*, there are a pair of wheels 15*a*, 15*b* mounted at the end of each leg 14 of the horizontal carrier 10 rollable along the rails 11, 12. Each pair of wheels 15*a*, 15*b* are dimensioned such that their rail-contact points are spaced apart a distance D (FIG. 7*a*) which is larger than the length (d) of the respective gap (11*a*, 12*a*). This arrangement permits the horizontal carrier 10 to smoothly traverse the gaps in the rails, as shown in FIGS. 7*a*–7*c*. One or more pairs of wheels 15*a*, 15*b* may be driven by traction motors, shown schematically at 38 in FIG. 7*b*.

FIG. 10 illustrates a hydraulic drive circuit which may be used for driving the cylinders 23 of the two raising and lowering mechanisms 20 at the opposite ends of the horizontal carrier 10. The cylinders at the opposite sides of the horizontal carrier 10 are shown at 23*a*, 23*b*. Both are driven via a proportional control valve 40 and a hydraulic rotary flow divider 41 supplying the ram cylinders 23*a*, 23*b* via balancing valves 42*a*, 42*b*. This arrangement obviates the need for a mechanical linkage between the raising and lowering mechanisms 20 at the opposite ends of the horizontal carrier 10, and assures that both mechanisms will move together, in synchronism with each other, both during their raising movements as well as their lowering movements.

The illustrated system operates as follows:

As indicated earlier, for each parking space there is a tray 5 supported across the tracks 11, 12.

As a vehicle enters one of the entrances 3, 4, for the respective column, the tray for the parking space to receive that vehicle is conveyed to the vertical lift 6 or 7, for the respective column C1, C3. The vehicle is driven directly onto the tray 5 in the vertical lift and is rotated 90 degrees by the respective turntable 8, 9. If the vehicle is to be parked on the street level SL, the lifting device 8 merely lifts the vehicle to the raised position of the horizontal carrier 10 for that level, which horizontal carrier is positioned to overlie the lifting device; on the other hand, if the vehicle is to be parked in a higher or lower level, the vertical lift 8 is raised or lowered to the selected level, for transfer to the horizontal carrier 10 of that level, which is positioned to overlie the lifting device when it reaches the respective level. The gaps 11*a* in the horizontal rails 11 accommodate the cantilever arm 28 which moves through the various levels until reaching the selected level for parking the vehicle.

FIG. 7*b* illustrates the condition of the lift 6 when transferring the vehicle to the horizontal carrier 10 for the respective level. As seen in FIG. 7*b*, the transfer is effected while the raising and lowering mechanism 20 of the carrier is in its raised condition, thereby saving the time that would otherwise be needed for raising the vehicle after having been conveyed and attached to its respective horizontal carrier 10.

The raising and lowering mechanism 20 at each of the two ends of the horizontal carrier 10 are thus in their raised positions, as shown by the broken-line positions of arms 21 and link 21*a* in FIG. 8, when the vehicle is conveyed to the horizontal carrier 10 by the vertical lift 6. The fastening hooks 18 of the horizontal carrier are also in their released condition. As soon as the vehicle has been conveyed to the horizontal carrier, hooks 18 are actuated by ram cylinders 24 to engage pins 17 on the vehicle tray 5, and thereby to secure the tray, and the vehicle thereon, to the horizontal carrier 10. The traction motor or motors (38, FIG. 7*b*) of the horizontal carrier 10 are then actuated to convey the vehicle over any other vehicles that may be parked at that level to the selected parking position. When the selected parking position is reached, ram cylinders 23 of the horizontal carrier 10 are actuated to pivot their arms 21 and links 21*a* to the lower position, thereby lowering the tray, and the vehicle thereon, to its preselected parking space. Cylinders 24 for the fastening hooks 18 are then actuated to disengage from pins 17 of the tray 16, and cylinders 23 are actuated to pivot arms 21 and links 21*a* to their raised positions, ready to receive another vehicle to be parked at that level.

When the next vehicle is to be parked, a parking space is selected, and the horizontal carrier 10 in the respective level is utilized for conveying the tray 5 of that parking space to the vertical lift 6, 7, for receiving the next vehicle, whereupon the procedure is repeated for conveying the next vehicle to its selected parking space.

For retrieving a vehicle from its parking space, the procedure is reversed. That is, the horizontal carrier 10 of the respective level is conveyed to overlie the vehicle to be retrieved; the arms 21 at the opposite ends of the horizontal carrier are pivoted to their lower positions; the securing hooks 18 are actuated to engage the pins 17 of the tray 5 of the respective vehicle; the arms 21 are then pivoted to their raised position; and the carrier 10 is moved along rails 11, 12 to convey the tray and its vehicle to overlie the vertical lift 6, 7, whereupon the vehicle tray is released from the horizontal carrier and is lowered (or raised) to the street level SL, for removal via the exit 3, 4 for the respective vertical column.

The overall parking system can be computerized in order to minimize the time for parking and retrieving the vehicles according to the prevailing conditions. In the described arrangement, the vertical lift may be used for moving the vehicle to the raised position of the vehicle on its horizontal carrier 10 before the vehicle is attached to the horizontal carrier while parking the vehicle, and similarly for receiving the vehicle from the raised position of the horizontal carrier during the retrieval of the vehicle from its parking space. Such an arrangement thus saves considerable time that would otherwise be required for raising the vehicle and its tray after having been attached to the horizontal carrier 10 during parking the vehicle, and also for lowering the vehicle and its tray onto the vertical lift when retrieving the vehicle.

In addition, the illustrated arrangement permits the vertical lift 6, 7 to be included at any convenient location along the length of the levels, rather than only at an extreme end of the levels, thereby further saving considerable transit time in transporting the vehicle from the vertical lift to its selected parking space or from its parking space to the vertical lift.

FIGS. 11 and 12 illustrate a further variation which may be used in order to adapt the parking system to the shape of the available plot of land. In this variation, the plot of land may be of a curved configuration. Accordingly, as shown in FIG. 11, the rails 111, 112 of each level are also of curved configuration. In addition, the wheels 115*a*, 115*b* are mounted by a pivotal mounting 116 to the lower ends of the legs 114 at the horizontal carriers, to thereby enable the wheels to traverse the rails (112) and also the gap (112*a*) in the respective rail.

In all other respects, the construction and mode of operation of the vehicle parking system illustrated in FIGS. 11 and 12 are substantially the same as described above.

While the invention has been described with respect to several preferred embodiments, it will be appreciated that these are set forth merely for purposes of example, and that many other variations, modifications and applications of the invention may be made.

What is claimed is:

1. A vehicle parking system, comprising:

a pair of horizontal rails spaced apart to define a line of vehicle parking spaces between them;

a horizontal carrier movable over said rails for conveying vehicles to selected parking spaces;

and a vertical lift located laterally of said pair of rails for lifting onto said horizontal carrier a vehicle to be parked;

said horizontal carrier comprising a frame structure for receiving a vehicle to be parked, and four legs depending from four corners of the frame structure and carrying wheels rollable along said rails;

said legs being of a height to enable the frame structure, and the vehicle supported thereby, to move over other vehicles that may be parked in said parking spaces;

at least one of the rails being interrupted to produce a gap sufficiently large to accommodate said vertical lift when lifting a vehicle onto said horizontal carrier, wherein said horizontal carrier is arranged to receive said vehicle to be parked from said vertical lift at a height which enables said frame structure and said vehicle to move over other vehicles that may be parked in said parking spaces, and said horizontal carrier is arranged such that said vertical lift can travel between said legs to deliver said vehicle to be parked to said frame structure at said height which enables said frame structure and said vehicle to move over other vehicles that may be parked in said parking spaces.

2. The system according to claim 1, wherein said vertical lift includes an arm mounted in cantilever fashion from one side of the rails and moving through said gap when lifting a vehicle onto said horizontal carrier.

3. The system according to claim 1, wherein said vertical lift extends transversely across said horizontal carrier and said pair of rails, both of said rails being interrupted to produce gaps aligned with each other through which the vertical lift moves when lifting a vehicle onto said horizontal carrier.

4. The system according to claim 3, wherein each of said legs carries two wheels having rail contacting surfaces spaced a greater distance apart than the length of said gaps.

5. The system according to any one of claims 1–4, wherein said vertical lift comprises a turntable for rotating a vehicle to be parked.

6. The system according to claim 1, wherein said rails extend transversely to the longitudinal axis of the vehicle to be conveyed, and said vertical lift includes a longitudinal axis which extends parallel to the longitudinal axis of the vehicle to be conveyed.

7. The system according to claim 1, wherein there is a tray for each vehicle supported on said rails, and wherein said horizontal carrier further includes:

a vehicle supporting member for supporting the vehicle and its tray received on the horizontal carrier;

securing devices for securing the vehicle tray to said vehicle supporting member;

and a raising and lowering mechanism for raising and lowering the vehicle supporting member, and the vehicle and its tray supported thereby, with respect to said frame structure.

8. The system according to claim 7, wherein said tray has a pair of laterally-projecting pins at each end of the tray for supporting the tray, and the vehicle thereon, on said pair of rails; said securing devices including a hook carried by said vehicle supporting member for each of said pins and actuatable to engage its respective pin.

9. The system according to claim 7, wherein said raising and lowering mechanism includes a pivotal arm at each end of the frame structure, one end of each pivotal arm being pivotally mounted to the frame structure, the opposite end of each pivotal arm being coupled via a link to the vehicle supporting member.

10. The system according to claim 1, wherein said pair of rails are curved, and said wheels are pivotally mounted to the respective legs to enable the horizontal carrier to traverse said curved rails.

11. The system according to claim 1, wherein there are a plurality of parking levels, each level including a pair of said horizontal rails defining a line of vehicle parking spaces between them, with the gaps in the rails of all the levels in vertical alignment, and a plurality of trays supported on said rails;

each level further including a said horizontal carrier movable over the rails of the respective level for conveying vehicles on their trays to selected parking spaces;

said vertical lift being located laterally of the rails of all said levels and being movable within said aligned gaps.

12. A vehicle parking system, comprising:

a supporting structure having a plurality of parking levels;

each of said levels including a pair of horizontal rails spaced apart to define a line of vehicle parking spaces between them, a plurality of trays supported on said rails, and a horizontal carrier movable over said rails of the respective level for conveying vehicles to the trays of selected parking spaces;

and a vertical lift for lifting a vehicle to be parked and a tray upon which said vehicle rests to the horizontal carrier of a selected level;

each of said horizontal carriers comprising a frame structure for receiving a vehicle to be parked and its tray, and four legs depending from four corners of the frame structure and carrying wheels rollable along said rails;

said legs being of a height to enable the frame structure, and the vehicle and tray supported thereby, to move over other vehicles that may be parked in said parking spaces;

at least one of the rails of each level being interrupted to produce a gap sufficiently large to accommodate said vertical lift when said vertical lift lifts a vehicle onto said horizontal carrier of each level, wherein each said horizontal carrier is arranged to receive said vehicle to be parked from said vertical lift at a height which enables said frame structure and said vehicle to move over other vehicles that may be parked in said parking spaces, and each said horizontal carrier is arranged such that said vertical lift can travel between said legs to deliver said vehicle to be parked to said frame structure at said height which enables said frame structure and said vehicle to move over other vehicles that may be parked in said parking spaces.

13. The system according to claim 12, wherein said vertical lift includes an arm mounted in cantilever fashion from one side of the rails of each level and moving through said gap when lifting a vehicle onto said horizontal carrier of each level.

14. The system according to claim 12, wherein said vertical lift extends transversely across said horizontal carrier of each level and said pair of rails of each level, and both of said rails of each level are interrupted to produce gaps aligned with each other through which the vertical lift moves when lifting a vehicle onto said horizontal carrier.

15. The system according to claim 12, wherein each of said legs carries two wheels having rail contacting surfaces spaced a greater distance apart than the length of said gaps.

16. The system according to any one of claims 12–15, wherein said vertical lift comprises a turntable for rotating a vehicle to be parked and its tray.

17. The system according to claim 12, wherein said rails extend transversely to the longitudinal axis of the vehicle to be conveyed, and said vertical lift includes a longitudinal axis which extends parallel to the longitudinal axis of the vehicle to be conveyed.

18. The system according to claim 12, wherein the horizontal carrier of at least one level further includes:

a vehicle supporting member for supporting the vehicle and its tray on said horizontal carrier of said at least one level;

securing devices for securing the vehicle tray to said vehicle supporting member;

and a raising and lowering mechanism for raising and lowering the vehicle supporting member, and the vehicle and tray supported thereby, with respect to said frame structure.

19. The system according to claim 18, wherein said tray has a pair of laterally-projecting pins at each end of the tray for supporting the tray and the vehicle thereon, on said pair of rails of said at least one level; said securing devices including a hook carried by said vehicle supporting member for each of said pins and actuatable to engage its respective pin.

20. The system according to claim 18, wherein said raising and lowering mechanism includes a pivotal arm at each end of the frame structure, one end of each pivotal arm being pivotally mounted to the frame structure, the opposite end of each pivotal arm being coupled via a link to the vehicle supporting member.

21. The system according to claim 12, wherein said pair of rails of each level are curved, and said wheels are pivotally mounted to the respective legs to enable the horizontal carrier of each level to traverse said curved rails.

* * * * *